US009134672B2

(12) United States Patent
Iwasa et al.

(10) Patent No.: US 9,134,672 B2
(45) Date of Patent: Sep. 15, 2015

(54) RECORDING MEDIUM DETERMINATION APPARATUS AND IMAGE FORMING APPARATUS

(71) Applicant: CANON KABUSHIKI KAISHA, Tokyo (JP)

(72) Inventors: Takeshi Iwasa, Yokohama (JP); Tsutomu Ishida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/289,605

(22) Filed: May 28, 2014

(65) Prior Publication Data

US 2014/0270825 A1 Sep. 18, 2014

Related U.S. Application Data

(63) Continuation of application No. 12/482,360, filed on Jun. 10, 2009, now Pat. No. 8,774,653.

(30) Foreign Application Priority Data

Jun. 13, 2008 (JP) ..... 2008-155360
May 13, 2009 (JP) ..... 2009-116606

(51) Int. Cl.
*G03G 15/00* (2006.01)

(52) U.S. Cl.
CPC ..... *G03G 15/5062* (2013.01); *G03G 15/5029* (2013.01); *G03G 2215/00603* (2013.01); *G03G 2215/00637* (2013.01); *G03G 2215/00742* (2013.01)

(58) Field of Classification Search
CPC ..... G03G 15/5029; G03G 2215/00742; G03G 2215/00637; G03G 2215/00603
USPC ..... 399/9, 11–13, 16, 45
See application file for complete search history.

(56) References Cited

U.S. PATENT DOCUMENTS 4,016,529 A * 4/1977 Inuzuka et al. ..... 367/93
2009/0003857 A1* 1/2009 Kuramochi et al. ..... 399/45

FOREIGN PATENT DOCUMENTS

| | | | |
|---|---|---|---|
| JP | H0139540 | Y2 | 11/1989 |
| JP | H05-026856 | A | 2/1993 |
| JP | H07-058178 | B2 | 6/1995 |
| JP | 2005-106950 | A | 4/2005 |
| JP | 2006-242804 | A | 9/2006 |
| JP | 2006-259589 | A | 9/2006 |
| JP | 2007-024837 | A | 2/2007 |

* cited by examiner

*Primary Examiner* — Walter L Lindsay, Jr.
*Assistant Examiner* — Jessica L Eley
(74) *Attorney, Agent, or Firm* — Canon U.S.A., Inc. IP Division

(57) ABSTRACT

A recording medium determination apparatus that determines grammage of a recording medium by using an ultrasonic wave includes a transmission unit configured to output an ultrasonic wave having a predetermined frequency, a reception unit configured to receive the ultrasonic wave output from the transmission unit and transmitted through the recording medium and output a received signal, a calculation unit configured to calculate a signal having a peak component according to a cycle of the received signal, and a determination unit configured to determine the grammage of the recording medium based on the signal calculated by the calculation unit.

45 Claims, 12 Drawing Sheets

RECORDING MEDIUM DETERMINATION APPARATUS AND IMAGE FORMING APPARATUS

This application is a continuation application of U.S. patent application Ser. No. 12/482,360 filed Jun. 10, 2009, which claims priority from Japanese Patent Application Nos. 2008-155360 filed Jun. 13, 2008, and 2009-116606 filed May 13, 2008, which are hereby incorporated by reference herein in their entirety.

BACKGROUND OF THE INVENTION

1. Field of the Invention

The present invention relates to a determination apparatus that determines a type of a recording medium and an image forming apparatus that mounts the determination apparatus therein, and more specifically to the determination apparatus that determines grammage of the recording medium by irradiating an ultrasonic wave to the recording medium and detecting the ultrasonic wave transmitted through the recording medium and the image forming apparatus such as a copy machine and a laser printer that variably controls an image forming condition by using a determination result of the determination apparatus.

2. Description of the Related Art

An image forming apparatus such as a copy machine and a laser printer includes an image bearing member as an image forming unit, a development unit, a transfer unit, and a fixing unit. Each unit has a function as follows.

The image bearing member is a photosensitive drum including, for example, a photosensitive layer on which an electrostatic latent image is formed. The electrostatic latent image is formed, for example, by exposing the image bearing member with a laser beam.

Further, a development unit has a function for applying developer to the electrostatic latent image formed on the image bearing member to visualize the electrostatic latent image. The developing unit can use, for example, a development roller.

Further, as the transfer unit, for example, a transfer roller is used and the transfer unit has a function for transferring the developer image to the recording medium to be carried. Furthermore, the fixing unit includes a heating roller and a pressure roller.

The fixing unit has a function for heating and pressing by the heating roller and the pressure roller the recording medium on which the developer image is transferred by the transfer roller in order to fix the developer image onto the recording medium.

In the conventional image forming apparatuses, for example, a user sets various settings by a computer as an external apparatus. Or, the user sets a size and a type (hereinafter, referred to as a "paper type") of the recording medium using an operation panel provided on a main body of the image forming apparatus.

According to the settings, for example, the image forming apparatus is controlled to set a transfer condition (for example, a transfer voltage or a conveyance speed of the recording medium when transferred) or a fixing condition (for example, a fixing temperature, or a conveyance speed of the recording medium when fixed).

In order to decrease the user's burdens for setting the conditions via the computer or the operation panel, in recent years, there is provided an image forming apparatus including a determination sensor as a determination unit to allow the image forming apparatus to have a function for automatically determining the type of the recording medium.

Such an apparatus can automatically determine the type of the recording medium and set the transfer condition and the fixing condition described above according to the determination result.

More specifically, Japanese Patent Application Laid-Open No. 2001-139189 discusses an apparatus that determines a thickness by providing a light emitting source such as alight emitting diode (LED) at a position opposing a sensor and detecting the light (intensity of the transmitted light) that has been transmitted through the recording medium.

Further, Japanese Patent Application Laid-Open No. 57-132055 discusses an apparatus that determines grammage (weight per unit area) of the recording medium by irradiating the ultrasonic wave to the recording medium and detecting transmittance of the ultrasonic wave transmitted through the recording medium.

As discussed in the above Japanese Patent Application Laid-Open No. 57-132055, when measuring the grammage of the recording medium by using the ultrasonic wave, it is necessary to consider influences of an interference of the ultrasonic wave between an ultrasonic transmission unit (hereinafter, referred to as a "transmission unit" and an ultrasonic wave reception unit (hereinafter, referred to as a "reception unit") and a reflection wave of the ultrasonic wave generated between the transmission unit and the recording medium or between the recording medium and the reception unit.

Further, when an ultrasonic wave sensor is applied to the above-described image forming apparatus, since the ultrasonic wave is reflected by a conveyance path for conveying the recording medium and a member such as a conveyance roller, it is also necessary to consider influence by the reflection wave.

For example, as discussed in Japanese Patent Application Laid-Open No. 57-132055, as a method for decreasing these influences, there is proposed a method for ending a measurement before a first interference of the reflected ultrasonic wave emitted from the transmission unit reaches the reception unit. The transfer time of the ultrasonic wave between the transmission unit and the reception unit has been previously calculated.

Further, as another method for decreasing the influences of the reflected wave, as discussed in Japanese Patent Application Laid-Open No. 2001-351141, the transmission unit and the reception unit are disposed obliquely with respect to the conveyance path to prevent the measurement from the influence of the ultrasonic wave reflected between the transmission unit and the recording medium or between the recording medium and the reception unit.

Furthermore, as discussed in Japanese Patent Application Laid-Open No. 2005-082350, there is proposed a method for decreasing the ultrasonic wave reflected by a peripheral member by disposing an acoustic absorbent (guide) at a periphery of the transmission unit and the reception unit.

In recent years, since high print quality has been increasingly demanded, it is necessary to form an image on various types of recording media used by a user without decreasing the print quality. More specifically, it is preferable to determine the type of the recording medium more accurately and form the image depending on the type thereof.

Particularly, in order to accurately detect the grammage of the recording medium, a method for detecting the grammage of the recording medium by using the ultrasonic wave is effective.

For a detection method by the ultrasonic wave, it is preferable that other member does not exist at a periphery of the sensor and also an environment at the periphery of the sensor is maintained under a predetermined condition. It is because the level of the ultrasonic wave, which is reflected by the other member, and received and detected by the sensor, varies. As a result, the level of the detected ultrasonic wave varies due to the variation of the environment caused by the reflected ultrasonic wave.

However, if the ultrasonic sensor is applied to the image forming apparatus, it is difficult to maintain the state and the environment of the periphery of the sensor in a predetermined condition due to the following situations.

Firstly, when the recording medium is carried, the recording medium is not always in a steady position. That is, the recording medium vibrates when carried. This is generally referred to as up-and-down movements of the recording medium. The up-and-down movements cause the recording medium to be vibrated, bended, and tilted in a vertical direction with respect to a conveyance direction.

The recording medium is rarely conveyed in the same attitude and the same position. The amount of up-and-down movements varies every time the recording medium is conveyed. As a result, a distance between the transmission unit and the recording medium and between the recording medium and the reception unit may be changed. Therefore, since the level of the signal received by the reception unit varies, it may be difficult to detect the received signal accurately.

Further, the environment where the image forming apparatus with the sensor therein is set does not always have a constant temperature, humidity, or atmospheric pressure. For example, when the ambient environment does not have a normal temperature or a normal humidity, a propagation speed in the air varies depending on the environment such as a low temperature, a low humidity, a high temperature, or a high humidity.

Therefore, when the ultrasonic wave is detected at the same timing as detected in the normal temperature or a normal humidity, the level (voltage) of the received signal may be changed. Further, since amplitude of the transmitted signal from the transmission unit is changed due to the variation of the atmospheric pressure in addition to the temperature and the humidity, the level of the received signal may be changed as well.

Furthermore, a variety of members to be used for forming images exist at the periphery of the sensor. The ultrasonic wave is reflected by the peripheral members of the transmission unit and the reception unit, and the sensor is influenced by the reflected ultrasonic wave (can be interfered).

For example, the signal acquired at a stage where the level of the signal becomes stable at a certain value after the ultrasonic signal is transmitted includes the reflected ultrasonic wave and, thus, does not have a correct level.

For example, Japanese Patent Application Laid-Open No. 57-132055 as described above discusses a method for receiving the ultrasonic wave without being influenced by the reflection wave of the ultrasonic wave. Therefore, the transmission time of the ultrasonic wave from the transmission unit to the reception unit is measured without the storage medium placed, and the grammage of the recording medium is determined based on a signal received by the reception unit after the measured transmission time has elapsed with the recording medium placed.

More specifically, Japanese Patent Application Laid-Open No. 57-132055 defines the transmission time of the ultrasonic wave as a time from a start of driving the transmission unit to a rising of a waveform of the output signal received by the reception unit. However, the rising of the output signal waveform of the ultrasonic wave signal varies according to a variation of an ambient environment such as the temperature, the humidity, and the atmospheric pressure. Accordingly, the above-described transmission time changes.

In order to correct or cancel an amount of the variation, the propagation time of the ultrasonic wave and the recording medium need to be measured alternately and frequently. However, when the propagation time is measured frequently for determining the recording medium, a procedure for determination becomes very complicated and takes time.

Further, when the recording medium is placed between the transmission unit and the reception unit for respectively transmitting and receiving the ultrasonic wave, the recording medium causes attenuation of the ultrasonic wave. Japanese Patent Application Laid-Open No. 57-132055 discusses a method for detecting an output in one cycle of the received signal waveform from a beginning of the measurement. Therefore, for example, a sufficient output for the recording medium having large grammage may not be acquired, since the output for the first several cycles of the received signal are extremely small.

SUMMARY OF THE INVENTION

According to an aspect of the present invention, a recording medium determination apparatus that determines grammage of a recording medium by using an ultrasonic wave includes a transmission unit configured to output an ultrasonic wave having a predetermined frequency, a reception unit configured to receive the ultrasonic wave output from the transmission unit and transmitted through the recording medium and output a received signal, a calculation unit configured to calculate a signal having a peak component according to a cycle of the received signal, and a determination unit configured to determine the grammage of the recording medium based on the signal calculated by the calculation unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments of the invention and, together with the description, serve to explain the principles of the invention.

DETAILED DESCRIPTION OF THE EMBODIMENTS

Various exemplary embodiments, features, and aspects of the invention will now be herein described in detail below with reference to the drawings. It is to be noted that the relative arrangement of the components, the numerical expressions, and numerical values set forth in these embodiments are not intended to limit the scope of the present invention.

A configuration of a grammage determination apparatus that detects grammage of a recording medium according to a first exemplary embodiment of the present invention and an operation thereof for detecting the grammage of the recording medium by using a sensor will be described with reference to FIGS. 1 and 2.

Figure 1:
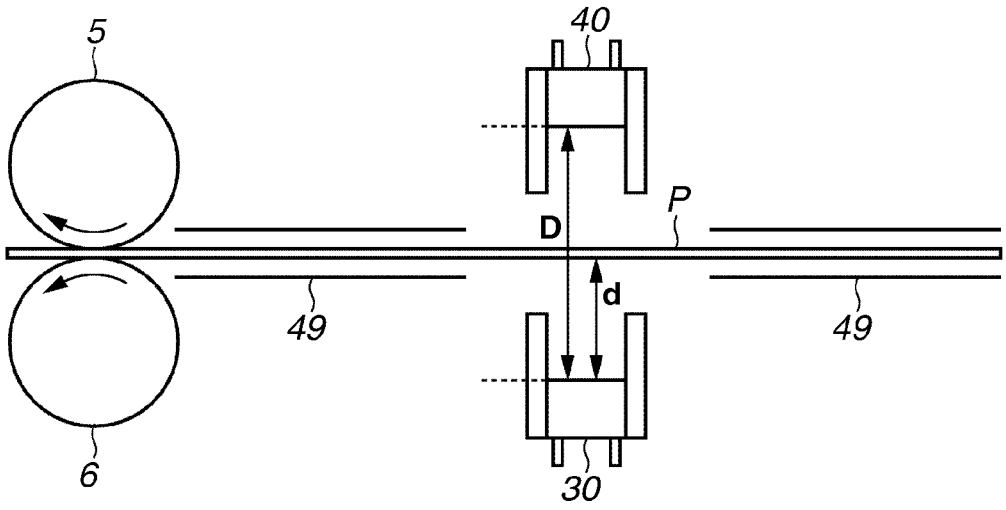
FIG. 1 illustrates a configuration of a grammage detection sensor for a recording medium according to a first exemplary embodiment.

FIG. 1 illustrates a configuration of the grammage determination apparatus that detects the grammage of a recording medium P. The grammage determination apparatus includes a grammage detection sensor and a mechanism for conveying the recording medium P. The grammage detection sensor includes a transmission unit 30 for irradiating an ultrasonic wave to the recording medium P, a reception unit 40 for receiving the ultrasonic wave irradiated from the transmission unit 30, a guiding member for guiding the ultrasonic wave irradiated from the transmission unit 30 and a guiding member for guiding the ultrasonic wave that has been transmitted through the recording medium P to the reception unit 40.

Further, the mechanism for conveying the recording medium P includes a conveyance roller 5 for conveying the recording medium P, an opposing conveyance roller 6 provided opposing the conveyance roller 5, a conveyance guide 49 for forming a conveyance path of the recording medium P.

The transmission unit 30 and the reception unit 40 of the grammage detection sensor are each disposed at predetermined positions. According to the present exemplary embodiment, the transmission unit 30, the recording medium P, and the reception unit 40 are each disposed such that a distance between the transmission unit 30 and the recording medium. P is substantially equal to a distance between the reception unit 40 and the recording medium P.

FIG. 1 illustrates a distance D between the transmission unit 30 and reception unit 40. When a distance "d" is defined as a distance between the transmission unit 30 and the recording medium, FIG. 1 illustrates a state where the recording medium is conveyed at a position between the transmission unit 30 and the reception unit 40 to satisfy d=D/2. When the recording medium is actually carried, a value of "d" fluctuates.

The transmission unit 30 and the reception unit 40 have similar configurations, each of which includes electrode terminals and a piezoelectric element that mutually convert mechanical displacement and an electric signal (not illustrated).

In the transmission unit 30, when a pulse voltage having a predetermined frequency is input to the electrode terminals, the piezoelectric element oscillates to generate a sound wave, which is to be propagated in the air. Upon reaching the recording medium P, the sound wave vibrates recording medium P. The vibrating recording medium P vibrates the air at an opposite side as well.

As described above, the sound wave generated by the transmission unit 30 is transmitted to the reception unit 40 via the recording medium P. The piezoelectric element of the reception unit 40 generates an output voltage between the electrode terminals according to the amplitude of the received sound wave. This is an operating principle when the ultrasonic wave is transmitted/received by using the piezoelectric element.

The guiding member for guiding the ultrasonic wave irradiated from the transmission unit 30 and the guiding member for guiding the ultrasonic wave that has been transmitted through the recording medium P to the reception unit 40 are disposed to decrease influence of the reflected wave. Further, guiding members improve the directionality of the ultrasonic wave.

More specifically, the influence of the reflected ultrasonic wave from the peripheral member can be decreased, and the directionality is given to the ultrasonic wave irradiated from the transmission unit 30 by the guiding member. Thus, attenuation of energy (amplitude level of oscillation waveform) of the ultrasonic wave received by the reception unit 40 can be decreased.

Figure 2:
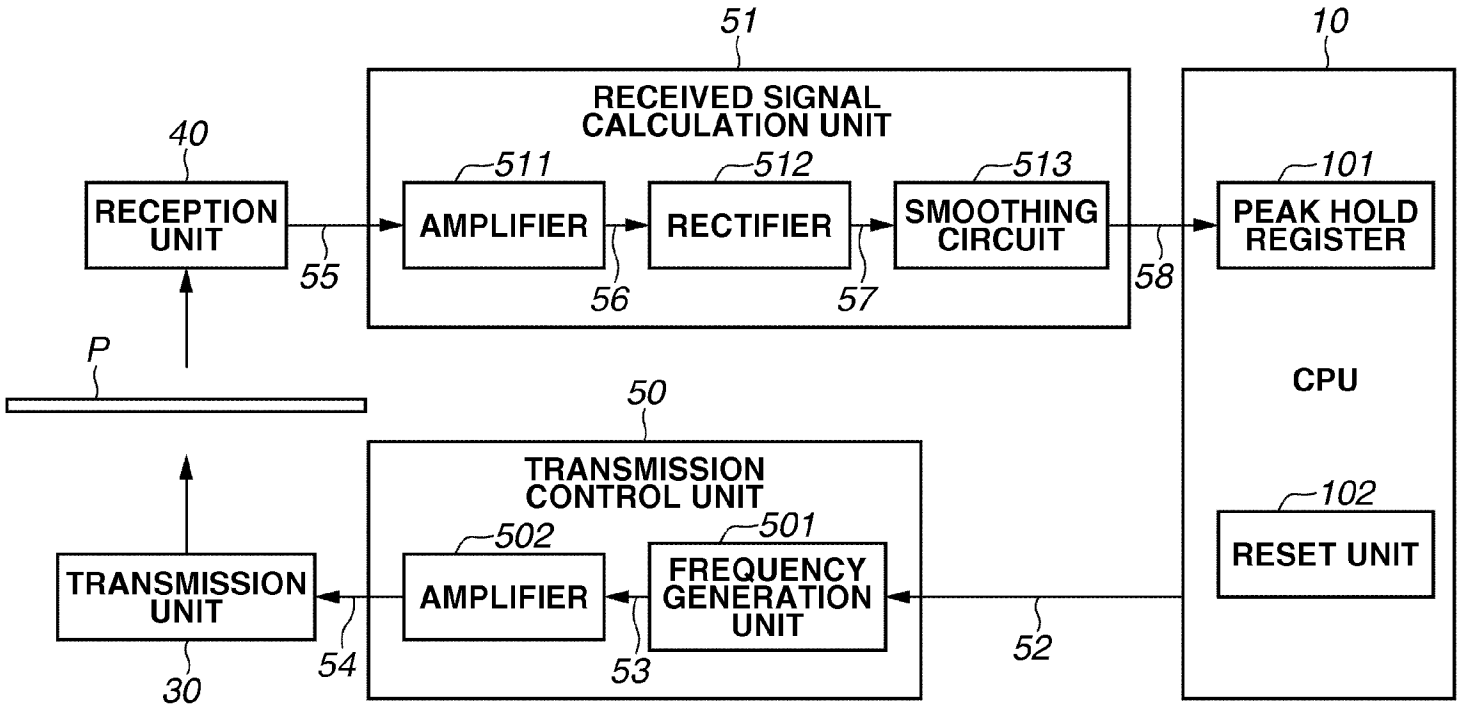
FIG. 2 is a block diagram illustrating a configuration of a control unit in the grammage detection sensor for the recording medium according to the first exemplary embodiment.

FIGS. 1 and 2 illustrate an example when a configuration and a control of the grammage detection sensor are realized, and the configuration is not limited to the present exemplary embodiment.

Figure 4:
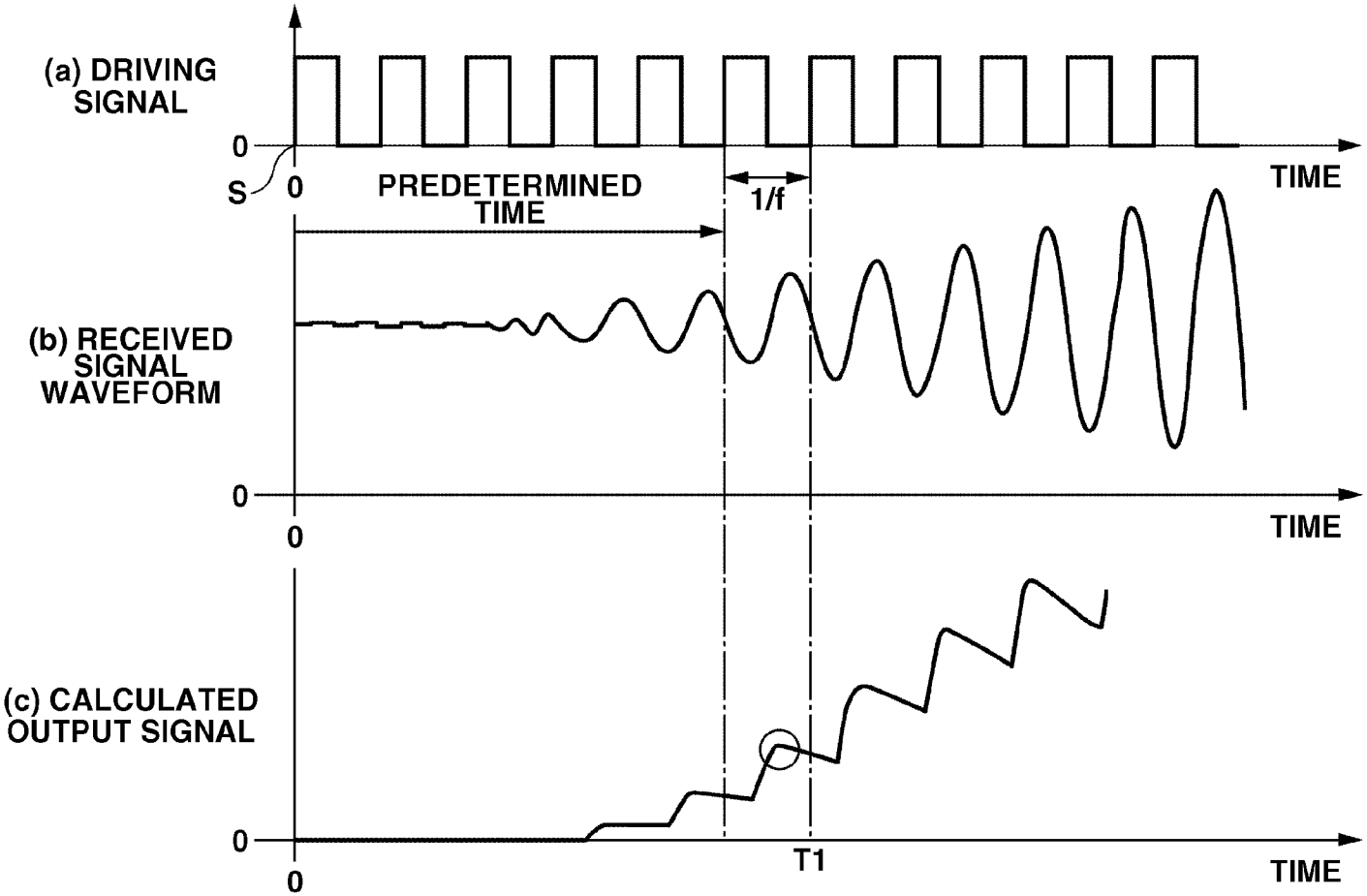
FIG. 4 illustrates an example waveform detected by the grammage detection sensor for the recording medium according to the first exemplary embodiment of the present invention.

FIG. 2 is a control block diagram illustrating an operation of the grammage detection sensor of a grammage determination apparatus. FIG. 4 illustrates output waveforms of a driving signal for driving the transmission unit 30 when the grammage detection sensor is operated, a received signal in the reception unit 40, and a calculated result of the received signal.

Firstly, with reference to FIG. 2, an example grammage detection operation of the recording medium P will be described. A CPU 10 functions as a control unit for controlling operations for transmitting and receiving the ultrasonic wave by the grammage detection sensor and a determination unit for performing an operation for determining the recording medium based on the received signal.

The CPU 10 transmits an ultrasonic wave transmission signal 52 to a transmission control unit 50 in order to transmit the ultrasonic wave having a predetermined frequency from the transmission unit 30. The transmission control unit 50 includes a frequency generating unit 501 and an amplifier 502 and functions as a signal output unit for outputting a signal to the transmission unit 30.

The ultrasonic wave transmission signal 52 includes information of a timing for driving the transmission unit 30 and the frequency of the ultrasonic wave signal to be transmitted. The information is previously stored (set) in a read only memory (ROM) (not illustrated).

A frequency generating unit 501 of the transmission control unit 50 generates and outputs a driving signal 53 having a frequency set based on the ultrasonic wave transmission signal 52 (a driving signal (a) in FIG. 4). The amplifier 502 amplifies a signal level (voltage) of the driving signal 53 and outputs the amplified driving signal 54 to the transmission unit 30 at a specified timing. The transmission unit 30 outputs the ultrasonic wave driven by the driving signal 54.

According to the present exemplary embodiment, a driving frequency of the ultrasonic wave is defined as 40 KHz (a driving frequency of the transmission unit 30 is 40 KHz), and the ultrasonic wave has a wavelength about 8.6 mm. The driving frequency may be previously selected in an appropriate range according to the configurations of the transmission unit and the reception unit, the grammage determination accuracy, and the like.

The reception unit 40 receives the ultrasonic wave from the transmission unit 30 or the ultrasonic wave that has been transmitted through the recording medium P and outputs a signal 55 (received signal (b) in FIG. 4) indicating intensity of the received ultrasonic wave to the calculation unit 51. The calculation unit 51 includes an amplifier 511, a rectifier 512, and a smoothing circuit 513.

The calculation unit 51 amplifies the signal 55 indicating the intensity of the received ultrasonic wave by the amplifier 511 and outputs a signal 56. The rectifier 512 rectifies the signal 56 and outputs a signal 57. Further, the smoothing circuit 513 smoothes the signal 57 and outputs a calculated output signal 58 ((c) in FIG. 4).

The calculated output signal 58 is input to the CPU 10. The CPU 10 performs processing for determining the grammage of the recording medium P by using the input calculated output signal 58. The processing will be described below.

Further, a peak hold register 101 stores a value acquired by a peak hold operation that will be described below. A reset unit 102 has a function for resetting a counter (not illustrated) in the CPU 10.

According to the present exemplary embodiment, in order for the smoothing circuit 513 to output a signal having a ripple component as illustrated in a calculated output signal (c) in FIG. 4, the smoothing circuit 513 employs a circuit having a time constant only when discharging.

The time constant of the smoothing circuit 513 according to the present exemplary embodiment is set to 1 ms. This time constant is acquired by performing an experiment by using a configuration of the above described ultrasonic wave sensor. When the frequency of the driving signal is changed, the time constant may be changed according to the changed frequency.

Figure 3:
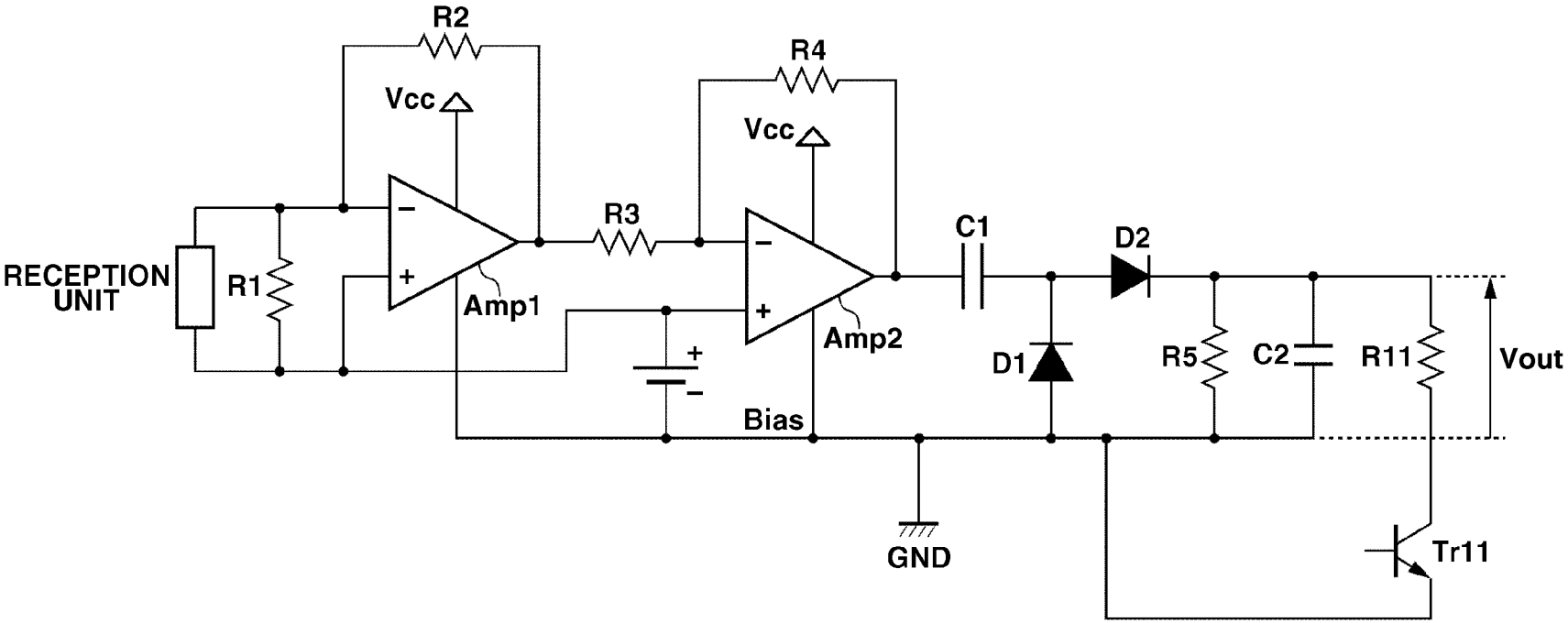
FIG. 3 is a schematic circuit diagram illustrating a reception unit and a received signal calculation unit in the grammage detection sensor for the recording medium according to the first exemplary embodiment of the present invention.

FIG. 3 illustrates a specific circuit configuration including the reception unit 40 and the calculation unit 51 as described with reference to FIG. 2.

A resistor R1 is a load resistance of the reception unit 40. The amplifier 511 includes a two-stage configuration, where the output of the reception unit 40 is current-amplified by an amplifier circuit including an amplifier Amp1 and a resistor R2 in a former stage and is voltage-amplified by an amplifier circuit including an amplifier Amp2 and resistors R3 and R4 in a latter stage.

The rectifier 512 includes capacitors C1 and C2 and diodes D1 and D2 to form a rectifier for performing a half-wave voltage doubler rectification. Further, the capacitor C2 together with a resistor R5 forms the incomplete smoothing circuit 513 having the time constant only when discharging.

A transistor Tr 11 and a resistor R11 form a discharge circuit, which is turned on, when detection is completed, to discharge a remaining charge of the capacitors C1 and C2 at a high speed. Thereby, a waiting time until next detection can be decreased. A base of the Tr 11 is controlled via an output port of the CPU 10 (not illustrated in FIG. 3) as illustrated in FIG. 2.

Since the circuit is operated by a single power-supply circuit (i.e., a power supply Vcc), an appropriate direct-current bias voltage Vb is supplied to a non-inverting input terminal of the amplifier 511. In order not to transmit the direct-current bias voltage Vb to the latter stage of the amplifier 511, the capacitor C1 also performs a direct-current cutting function.

The above-described circuit is an example circuit configuration and the configuration is not limited to the present exemplary embodiment. For example, the circuit may not be the single power-supply circuit but may be a dual power-supply circuit. A rectifying circuit may employ another circuit configuration. Further, the transistor Tr 11 may be replaced by a digital transistor or a field effect transistor (FET). Furthermore, the discharge circuit may be omitted.

Next, regarding the operation of the grammage detection sensor as described with reference to FIG. 2, a transmitted signal and a received signal of the ultrasonic wave, a calculated output signal, and an operation for sampling the calculated output signal will be described with reference to FIG. 4. FIG. 4 illustrates a waveform when the ultrasonic wave is irradiated to the recording medium. A longitudinal axis represents an output voltage, and a lateral axis represents a time.

In FIG. 4, a driving signal (a) illustrates a waveform of the driving signal 54 applied to the transmission unit 30. The driving signal has a previously set frequency (40 kHz according to the present exemplary embodiment). The transmission unit 30 is driven according to the driving signal 54 and generates the ultrasonic wave in the air (in a medium).

A received signal waveform (b) illustrates a waveform of an ultrasonic wave received signal by the reception unit 40. After a predetermined time has elapsed since the ultrasonic wave transmission signal has been transmitted, an output is gradually increased. The predetermined time is changed depending on a distance between the transmission unit 30 and the reception unit 40, and an ambient environment such as temperature and humidity.

A calculated output signal (c) is acquired by operating the received signal (b). The output waveform of the calculated output signal has a ripple component when it is output. This is a feature of the present exemplary embodiment.

The CPU 10 starts sampling of the calculated output signal (c) after the predetermined time elapses since the driving signal 54 has been output to the transmission unit 30 (a generation point S of the driving signal in FIG. 4) and performs sampling of the calculated output signal in a cycle of the frequency of the ultrasonic wave transmitted signal.

When the sampling operation is performed as described above, a signal including a maximum value of the calculated output signal (c) can be detected. The signal including the maximum value is illustrated by a circled part of the waveform of the calculated output signal (c) having a ripple component. The maximum value is acquired from the detected signal, and the grammage of the recording medium P is determined by using the value.

According to the present exemplary embodiment, the predetermined time that is a time for starting sampling is defined as 150 μs. The time is experimentally acquired and, if the configuration of the ultrasonic wave sensor is changed, an optimum value may be appropriately set according to the changed configuration.

A reason why the calculated output signal (c) having a ripple component that is a feature of the present exemplary embodiment is output will be described below.

The ultrasonic wave traveling from the transmission unit 30 to the reception unit 40 (hereafter, referred to as a "traveling wave") and the ultrasonic wave reflected by the reception unit 40 (hereafter referred to as a "reflected wave") have similar frequencies and similar speeds and opposite traveling directions. The traveling wave and the reflected wave are synthesized to generate a standing wave.

After a time elapses since the ultrasonic wave has been transmitted, multiple reflections are generated between the transmission unit 30 and the reception unit 40, and the output level of the ultrasonic wave is stabilized in a stable status. Unlike the traveling wave, the standing wave has a feature in which positions of a maximum amplitude and a minimum amplitude are stable.

Therefore, when the recording medium is placed at a position where the amplitude of the standing wave is the minimum (referred to as a "node" of the standing wave), the vibration of the recording medium is minimal. On the other hand, when the recording medium is placed at a position where the amplitude of the standing wave is the maximum (referred to as a "belly" of the standing wave), the vibration of the recording medium is maximal.

More specifically, if sampling is started after the transmission of the ultrasonic wave is started and the output level is stabilized in a stable status, the received signal can vary due to influence of the standing wave if a position of the recording medium varies.

It is possible to set a sampling block of the calculated output signal before the influence by the reflected wave from the peripheral member and the standing wave between the transmission unit 30 and the reception unit 40 appear. It is possible, for example, to set the sampling block to a block equivalent to a rising portion of the waveform.

More specifically, when an ending time of the sampling block "t" is defined as T1 [s], a distance from the transmission unit to the reception unit for receiving the ultrasonic wave is defined as "D"[m], a distance from the transmission unit for transmitting the ultrasonic wave to the recording medium is defined as d<D [m], a transmission speed of the ultrasonic wave in the air is defined as v[m/s], and the frequency of the ultrasonic wave is defined as f[Hz], the following formula may be satisfied. The value of "d" varies according to a conveying state of the recording medium.

$$T1-1/f \leq t \leq T1 \quad (1)$$

$$T1<(D+2d)/v \quad (2)$$

$$D/v+n/f \leq T1-1/f \text{ ("}n\text{" is an integer of 0 or more)} \quad (3)$$

The formula (1) describes that a sampling block "t" is defined as one period of the frequency of the driving signal. The formula (2) describes that a sampling ending time T2 needs to be earlier than a time when the ultrasonic wave transmitted from the transmission unit reaches the reception unit 40 after reflecting on the recording medium, reflecting on the transmission unit 30 again, and being transmitted through the recording medium.

Since the actual apparatus may have a restriction such as a setting condition of the transmission unit 30 and the reception unit 40, the formula (2) may not generate a desired output. However, since a primary reflected wave is attenuated more seriously than a direct wave and has a smaller amplitude, the appropriate ending time T1 may be set in a range in which a demanded detection accuracy is not greatly influenced.

More specifically, it is possible that a value (n) in a formula (3) is set as small as possible in a range in which the amplitude necessary for detecting the grammage of the recording medium can be acquired.

Existence of the recording medium and some types of the recording medium may cause a serious attenuation of the ultrasonic wave in a block of first several periods, and thus the output may not be generated. Thus, the formula (3) includes a condition that the sampling is started later than the ultrasonic wave first reaches the reception unit 40.

It is necessary to conduct an experiment in the block of the several periods to set the appropriate value (n). According to the present exemplary embodiment, as a result of the experiment, n=3 or 4 is the most appropriate value.

Figure 5:
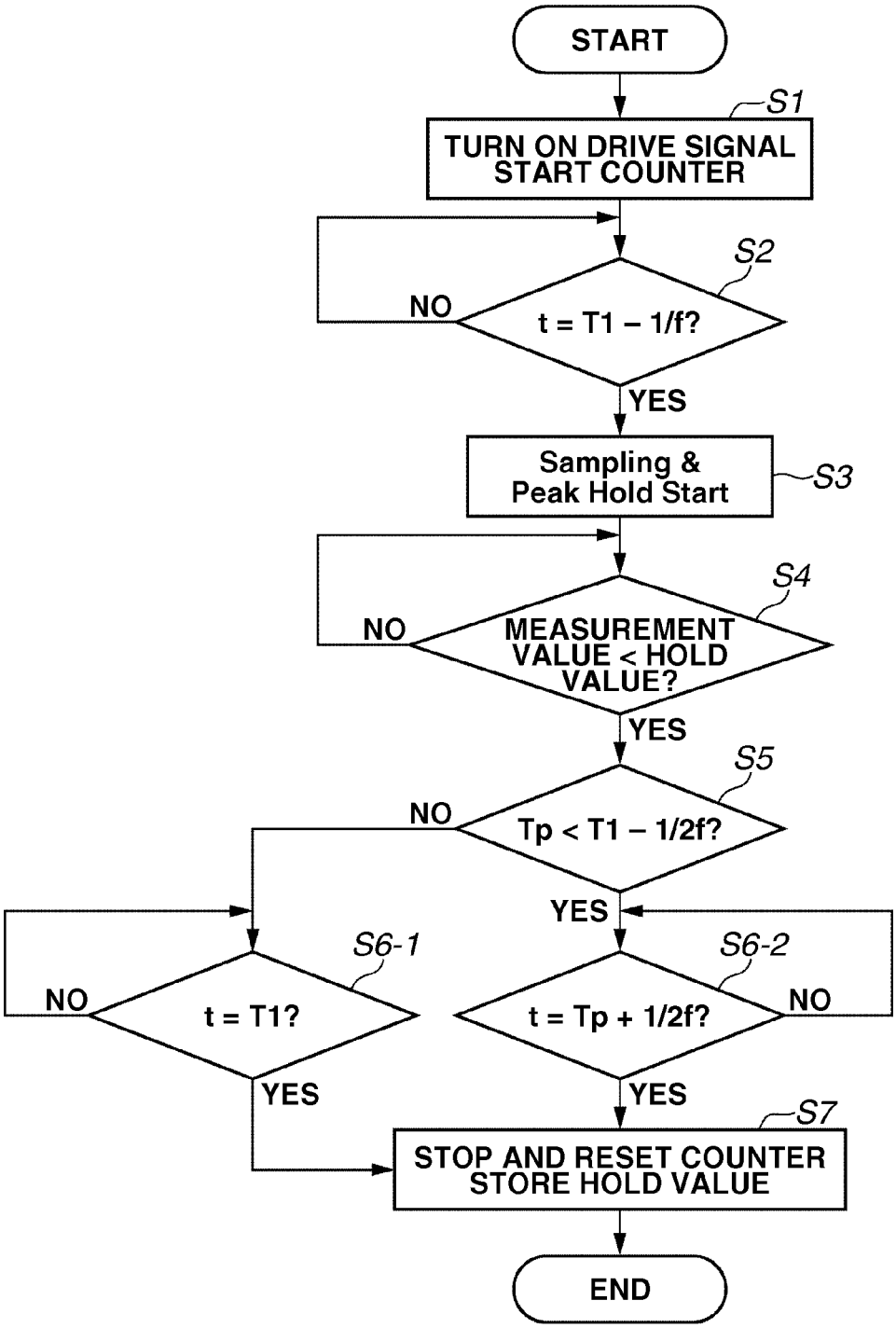
FIG. 5 is a flowchart illustrating a signal detection operation according to the first exemplary embodiment.

Next, regarding a method for detecting a maximum value (refer to FIG. 4) will be described below with reference to FIG. 5.

In step S1, the CPU 10 enables a counter (not illustrated) to start at the same time as transmitting the ultrasonic wave transmission signal 52 to the transmission control unit 50. In step S2, the CPU 10 determines whether a counter value reaches the sampling staring time T1−1/f that is previously set. When determining that the counter value reaches the sampling staring time T1−1/f (Yes in step S2), in step S3, the CPU 10 starts sampling of the calculated output signal 58.

In step S3, the CPU 10 analog/digital (A/D) converts the calculated output signal 58 and holds a peak value of the calculated output signal 58 (holding a maximum value of converted data), which is separately stored in the peak hold register 101 in the CPU 10.

In steps S5, S6-1, and S6-2, after a half period ½f of the ultrasonic wave has elapsed since a point Tp when a first peak has been detected in step S4, or after one period 1/f of the ultrasonic wave has elapsed since a measurement has been started, the sampling is ended at either earlier point.

This operation is performed to avoid a case where the maximum value that may not be a maximum value for some phase relationships between the sampling block "t" and the calculated output signal 58 is held as the peak value.

In step S7, at the same time as ending the measurement, the counter is reset in the reset unit 102 and prepared for the next measurement.

Simply to acquire the peak of the received signal waveform, the waveform after rectified may be input to the CPU 10 without smoothing processing. However, without the smoothing processing, the amplitude of the signal becomes smaller. Thus, the measurement is performed in a state where a dynamic range is not large enough. More specifically, the grammage determination accuracy of the recording medium may not be accurate enough.

Therefore, the smoothing processing is performed by using the smoothing circuit as described above, and also the signal having the ripple component (integral signal periodically generating the peak) is calculated so that the maximum value can be detected.

Figure 6:
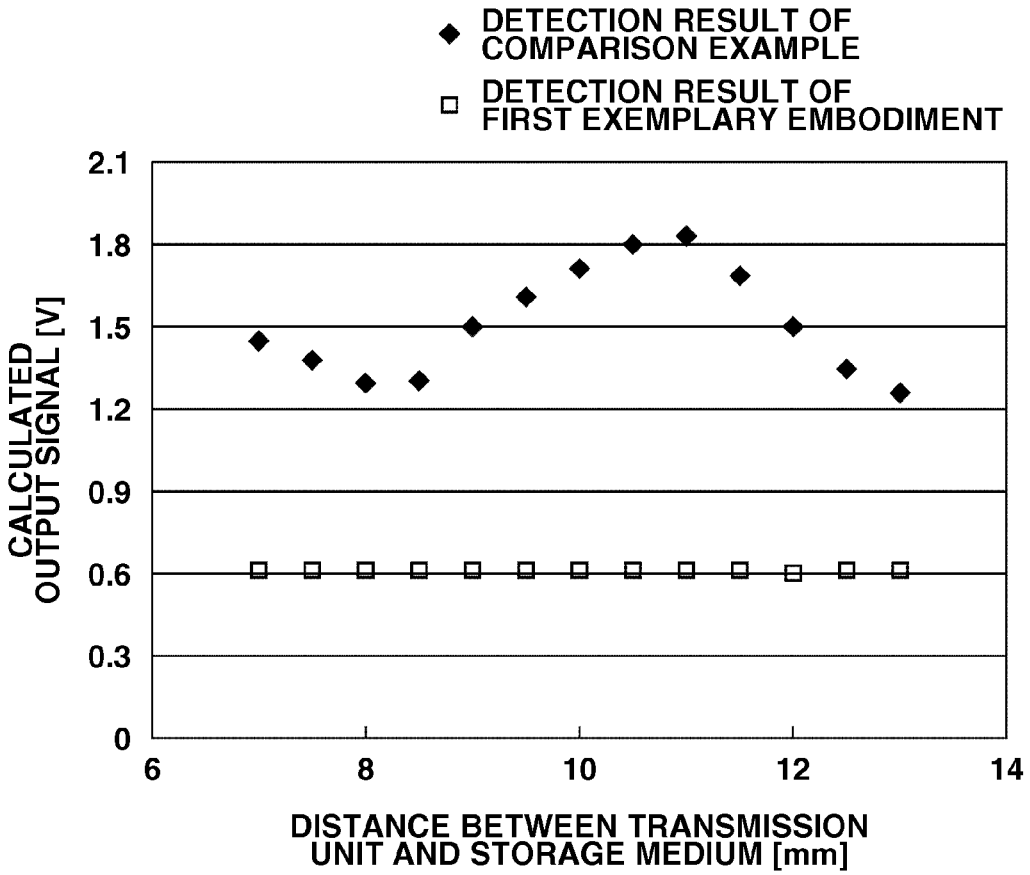
FIG. 6 illustrates an example detection result detected by the grammage detection sensor for the recording medium according to the first exemplary embodiment.

As one example for comparing to the present exemplary embodiment, FIG. 6 illustrates one example of the experiment result of cases where the grammage is measured by using the integral value (steady state value) after a fixed time elapses and where the grammage is determined by using the peak value (maximum value) of the rising waveform in the present exemplary embodiment.

In the experiment, the level of the received signal of the calculation unit 51 is measured when the position of the recording medium P from the transmission unit 30 is changed. The lateral axis of the graph in FIG. 6 represents a distance between the transmission unit 30 and the recording medium P. The longitudinal axis represents the output of the calculation unit 51.

According to the method for measuring the integral value after the fixed time elapses, it is understood that the output varies periodically depending on the distance between the sensor and the recording medium P. On the other hand, according to the method for measuring the peak of the rising waveform according to the present exemplary embodiment, a stable value can be measured without varying the output, although the position of the recording medium is changed.

Figure 7:
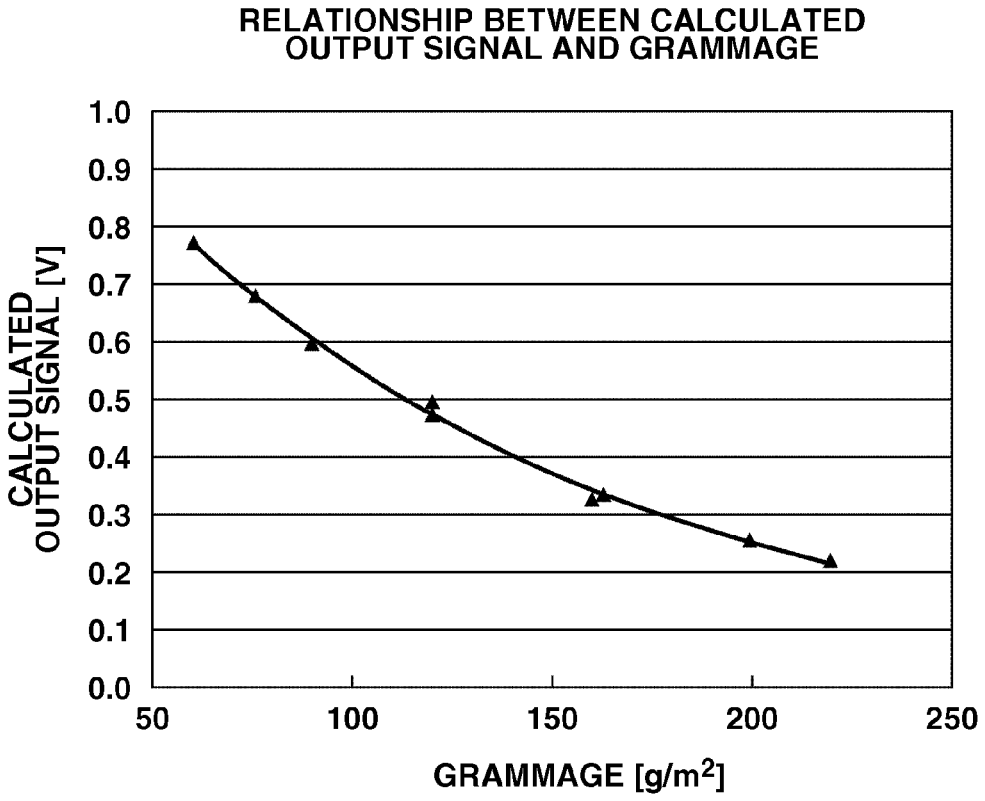
FIG. 7 illustrates an example relationship between grammage of the recording medium and a calculated output signal according to the first exemplary embodiment.

Further, FIG. 7 illustrates a relationship between the grammage and the calculated output signal generated by applying the present exemplary embodiment. This diagram illustrates that the grammage from 60 [g/m2] to 220 [g/m2] can be detected by applying the present exemplary embodiment.

FIG. 7 illustrates that the grammage can be accurately detected by using the calculated output signal generated by the method described in the present exemplary embodiment. The grammage in the present exemplary embodiment refers to a mass per unit area of the recording medium and is denoted as [g/m2] as a mass per one square meter.

As described above, according to the present exemplary embodiment, the smoothing processing is performed on the received signal of the ultrasonic wave to add the ripple component, and the maximum value of the signal acquired by the smoothing processing is detected. Based on the maximum value, the grammage of the recording medium is determined. Thus, while the influences of the environmental variation and the reflection from the peripheral member of the sensor are decreased, the grammage is detected in a short time by the simple method, thereby enabling the grammage determination accuracy to be improved.

According to a second exemplary embodiment, since a basic configuration except for the timing for detecting the rising waveform of the calculated output signal is similar to the first exemplary embodiment, the description of the detailed basic configuration will be omitted. The present exemplary embodiment is different from the first exemplary embodiment in that the detection timing of the signal is appropriately set according to the change of the ambient temperature of the grammage detection sensor.

In general, a speed "v" of the ultrasonic wave (hereafter, referred to as a "transmission speed") transmitting in the medium is denoted as follows.

$$v=331.5+0.607k \text{ [m/s] } (k\text{: centigrade temperature [° C.]} \quad (4)$$

The formula (4) describes that the speed of sound under an environment of temperature 0° C. is 331.5 [m/s] and a temperature coefficient of the speed of sound is 0.607 [(m/s)/° C.].

More specifically, the formula (4) describes that the speed varies according to the temperature change. Thus, the variation of the ambient temperature has the influence on the detection timing of the calculated output signal by the grammage detection sensor.

Further, the formula (4) describes that the waveform of the calculated output signal starts to rise faster under the environment of the higher temperature than the normal temperature, while the waveform of the calculated output signal starts to rise slower under the environment of the lower temperature than the normal temperature.

More specifically, if the timing for detecting the calculated output signal by the CPU 10 and a time width for detection (hereafter, referred to as a "detection window") are fixed to a certain condition, the peak of the waveform may not be accurately detected, when the timing and the detection window are influenced by the temperature change.

According to the present exemplary embodiment, a first detection for detecting the output of the reception unit 40, when the recording medium is not placed, is performed. At that time, the reception unit 40 receives the ultrasonic wave that is directly transmitted from the transmission unit 30. From the result of the first detection, a time from when the ultrasonic wave is emitted from the transmission unit 30 to when it is received by the reception unit 40 is measured. With the recording medium being placed, a second detection for detecting the peak of the calculated output signal is performed at a predetermined timing after the measured time has passed.

Figure 8:
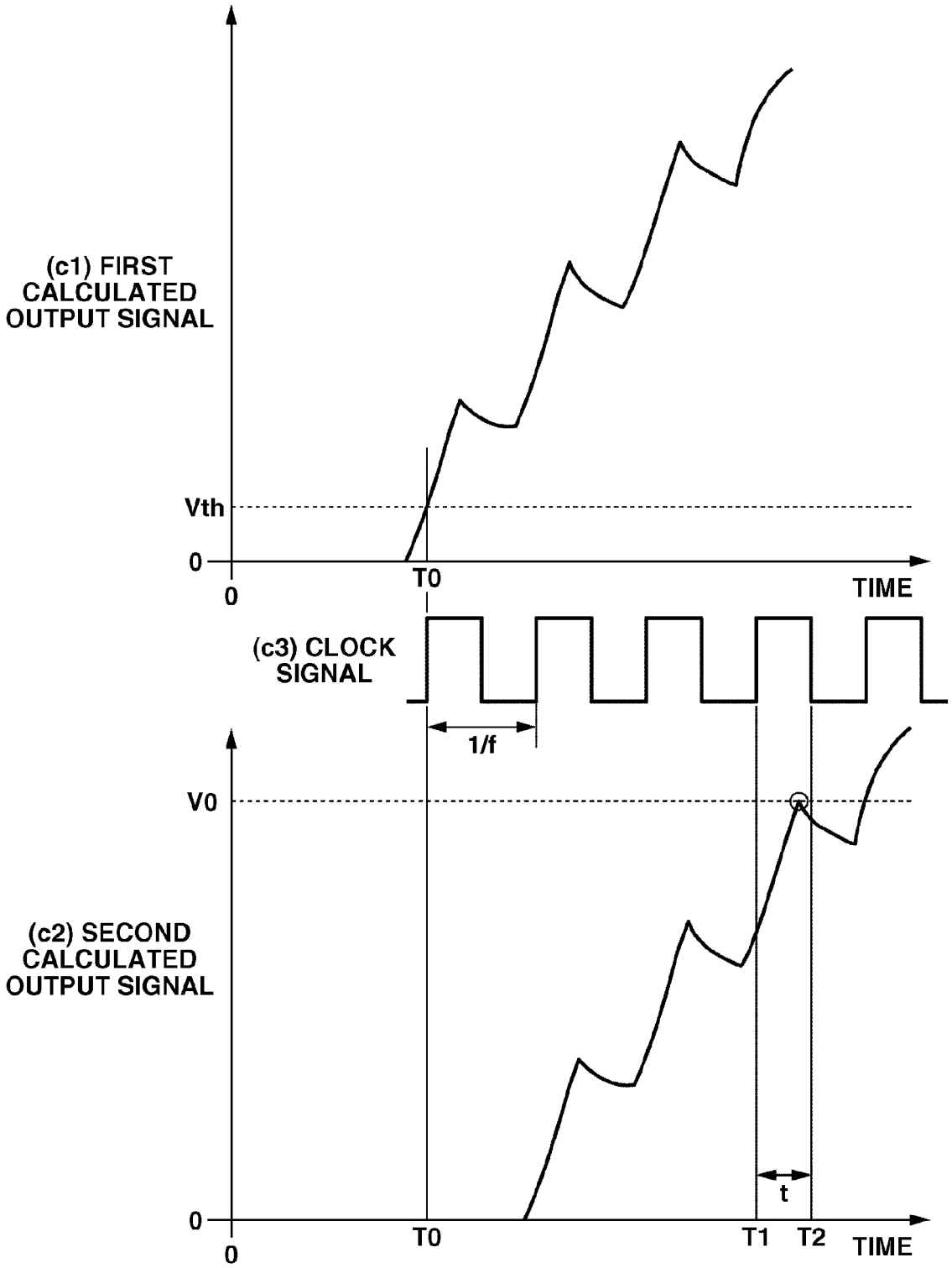
FIG. 8 illustrates example waveforms detected by a grammage detection unit for the recording medium according to a second exemplary embodiment.

FIG. 8 illustrates the waveforms of the calculated output signal when the first detection and the second detection are performed. A waveform of a first calculated output signal (c1) in FIG. 8 is generated when the first detection is performed when the recording medium is not placed between the transmission unit 30 and the reception unit 40.

At this point, a counter (not illustrated) starts to count from a time when the ultrasonic wave driving signal is generated (at a time of a point 0 when the driving signal has started to generate in FIG. 8) to measure a time T0 when the calculated output signal exceeds a previously-set threshold value Vth.

In FIG. 7, the longitudinal axis represents an output voltage and the lateral axis represents a time. The threshold value Vth may be previously set depending on the configuration of the reception unit.

Next, as illustrated in a waveform of a second calculated output signal (c2), the second detection is performed with the recording medium placed between the transmission unit 30 and the reception unit 40. At this time, a point T0 measured in the first detection is defined as a starting point, and the calculated output signal is detected during a half cycle "t" (between T1 and T2 in the diagram) after integer multiple of cycle T of the driving signal of the ultrasonic wave has elapsed.

A clock waveform (c3) in the diagram represents a clock signal having the same frequency as the driving signal and is used to set a detection timing with respect to a starting point T0. The waveform of the second calculated output signal c2 in FIG. 8 illustrates an example in which the detection is performed during the half-cycle period after three cycles have passed from the starting point T0. The half cycle "t" is set in a range described in the following formula (5).

$$T0+(2n-1)\times(1/2)T<t<T0+2n\times(1/2)T \text{ (}n\text{ is an integer of 1 or more)} \quad (5)$$

In the range of the half cycle period "t", a peak (maximum value) V0 of the rising waveform of the calculated output signal is detected. This is because the peak (maximum value) of the rising waveform always exists between the point T0 and the half cycle period T/2 as described above, which is repeated in every following period T.

The output may not be obtained when the recording medium has a large grammage, since the received signal attenuates greatly in the first several cycle periods. Accordingly, for example, by setting an integer "n" in the above formula to n=3 or 4 as illustrated in the waveform of the second calculated output signal c2 in FIG. 8, a detection period is set to a time between T1 and T2. Thereby, a detection result having a level needed for determining the grammage can be acquired.

Figure 9:
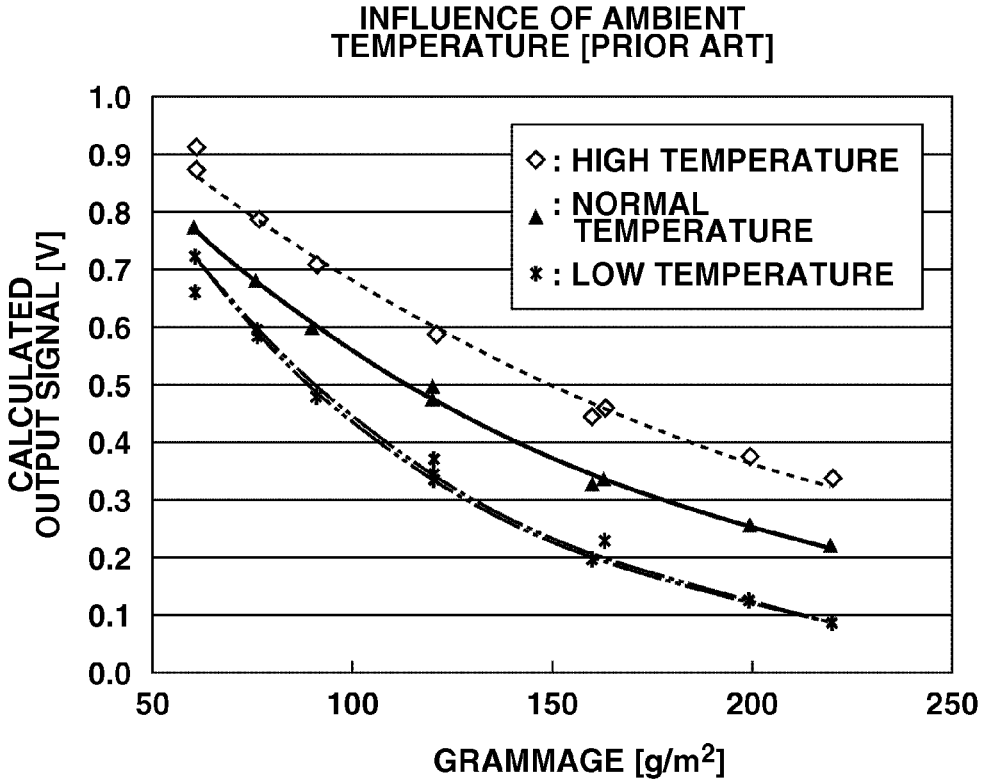
FIG. 9 illustrates a detection result of comparison examples detected by the grammage detection unit for the recording medium according to the second exemplary embodiment.

As an example for comparing to the present exemplary embodiment, FIG. 9 illustrates the relationship between the output and the grammage when the grammage is determined by using the integral value (steady state value) after the fixed time has elapsed. As illustrated in FIG. 9, when the present exemplary embodiment is not applied, the output varies according to the temperature change, thereby possibly causing an incorrect detection.

Figure 10:
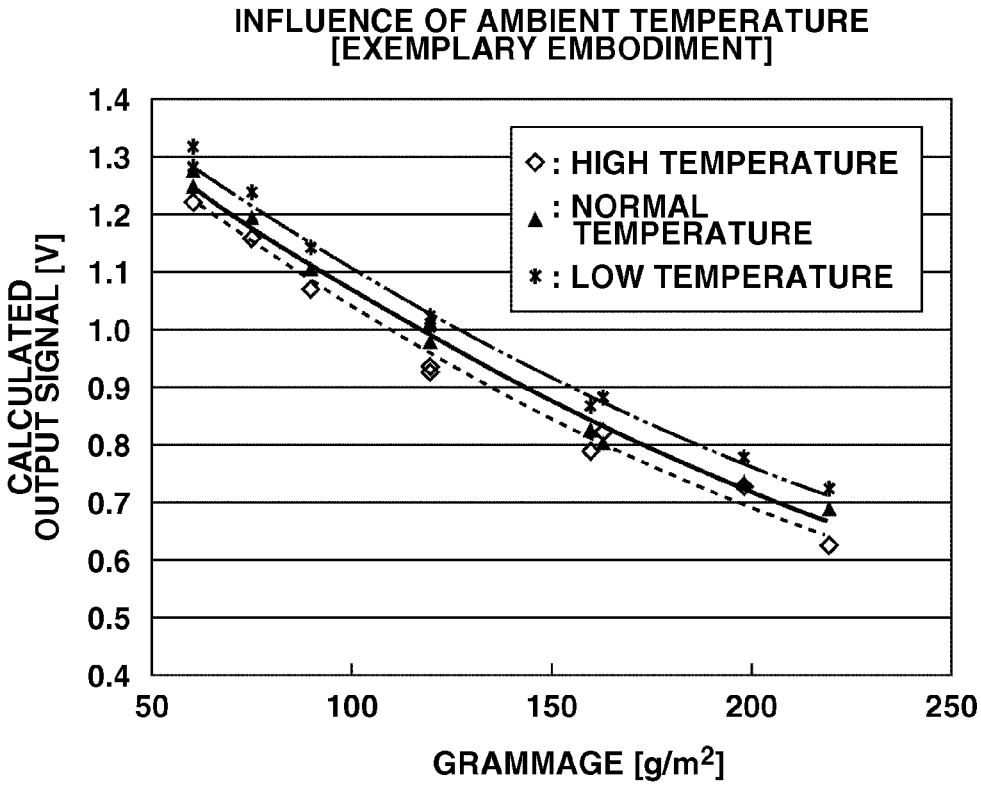
FIG. 10 illustrates a detection result detected by the grammage detection unit for the recording medium according to the second exemplary embodiment.

Further, FIG. 10 illustrates the relationship between the output and the grammage when the present exemplary embodiment is applied. As illustrated in FIG. 10, when the present exemplary embodiment is applied, the variation of the output is smaller and thus the grammage determination can be stably performed even if the temperature changes.

According to the present exemplary embodiment, the period for detecting the output waveform is set as one period of a half cycle. However, the grammage determination is not limited to using only the detection result acquired in one detection period. For example, a plurality of "n"s may be set in the formula (5), a plurality of the detection results from a plurality of detection periods may be used to perform an averaging processing to conduct the comprehensive determination.

As described above, according to the present exemplary embodiment, a time is measured when the calculated output signal exceeds the threshold value Vth without the recording medium placed between the transmission unit and the reception unit for respectively transmitting and receiving the ultrasonic wave. When the detection is performed with the recording medium placed, the peak of the rising waveform in the half cycle "t" is detected after the integer-multiple period of the driving signal has elapsed since the measured time.

This detection method can decrease or avoid the output variation and the incorrect detection caused by a wrong detection timing for the calculated output signal due to the influence of the ambient environment of the grammage detection sensor and especially the temperature change. The grammage of the recording medium can be determined with high accuracy in a short time.

According to a third exemplary embodiment, since a basic configuration except for a method for operating the detection result is similar to that of the first exemplary embodiment, the description of the detailed basic configuration will be omitted.

According to the present exemplary embodiment, similarly to the first exemplary embodiment as described above, the piezoelectric element is also used for the transmission unit 30 and the reception unit 40 for respectively transmitting and receiving the ultrasonic wave. In a configuration using the piezoelectric element, the transmission speed (speed "v" of the formula (4) in the second exemplary embodiment) of the ultrasonic wave varies according to the temperature change. Further, the output voltage from the piezoelectric element varies according to the change of the atmospheric pressure.

The present exemplary embodiment, specifically, has a feature of an operating method for decreasing (or canceling) influence of the variation of the output voltage from the piezoelectric element. Regarding the change of the transmission speed of the ultrasonic wave caused by the temperature change, the method described in the second exemplary embodiment can decrease the influence.

Firstly, a first detection is performed without the recording medium placed between the transmission unit 30 and the reception unit 40 for respectively transmitting and receiving the ultrasonic wave, and a value of the calculated output signal (hereinafter, the first detection result is defined as D1), which is a first detection result, is stored in a memory 70. Next, a second detection is performed with the recording medium placed between the transmission unit 30 and the reception unit 40 for respectively transmitting and receiving the ultrasonic wave.

The value of the calculated output signal, which is the second detection result (hereafter, the second detection result is defined as D2), and the value of the calculated output signal, which is the first detection result, are used for a calculation by using the following formula (6).

$$Dm=D2/D1 \tag{6}$$

This formula indicates that the second calculation result is divided by the first calculation result. As described above, the result Dm, which is a simple calculation processing result, is used as the value for determining the grammage. By using this formula, the variation of the output voltage from the piezoelectric element caused by the temperature change can be canceled and the values of the calculated output signal having a correlation with the grammage of the recording medium can be relatively compared with high accuracy.

As described above, according to the present exemplary embodiment, the detection result with the recording medium placed between the transmission unit and the reception unit for respectively transmitting and receiving the ultrasonic wave is divided (also referred to as "standardization") by the detection result without the recording medium placed between the transmission unit and the reception unit for respectively transmitting and receiving the ultrasonic wave.

By using the calculation, the variation of the output voltage from the piezoelectric element influenced by the atmospheric pressure can be decreased (or cancelled), and the grammage of the recording medium can be determined with high accuracy.

According to a fourth exemplary embodiment, since a basic configuration except for a method for using the detection result is similar to the first to third exemplary embodiments, the description of the detailed basic configuration will be omitted.

Figure 11:
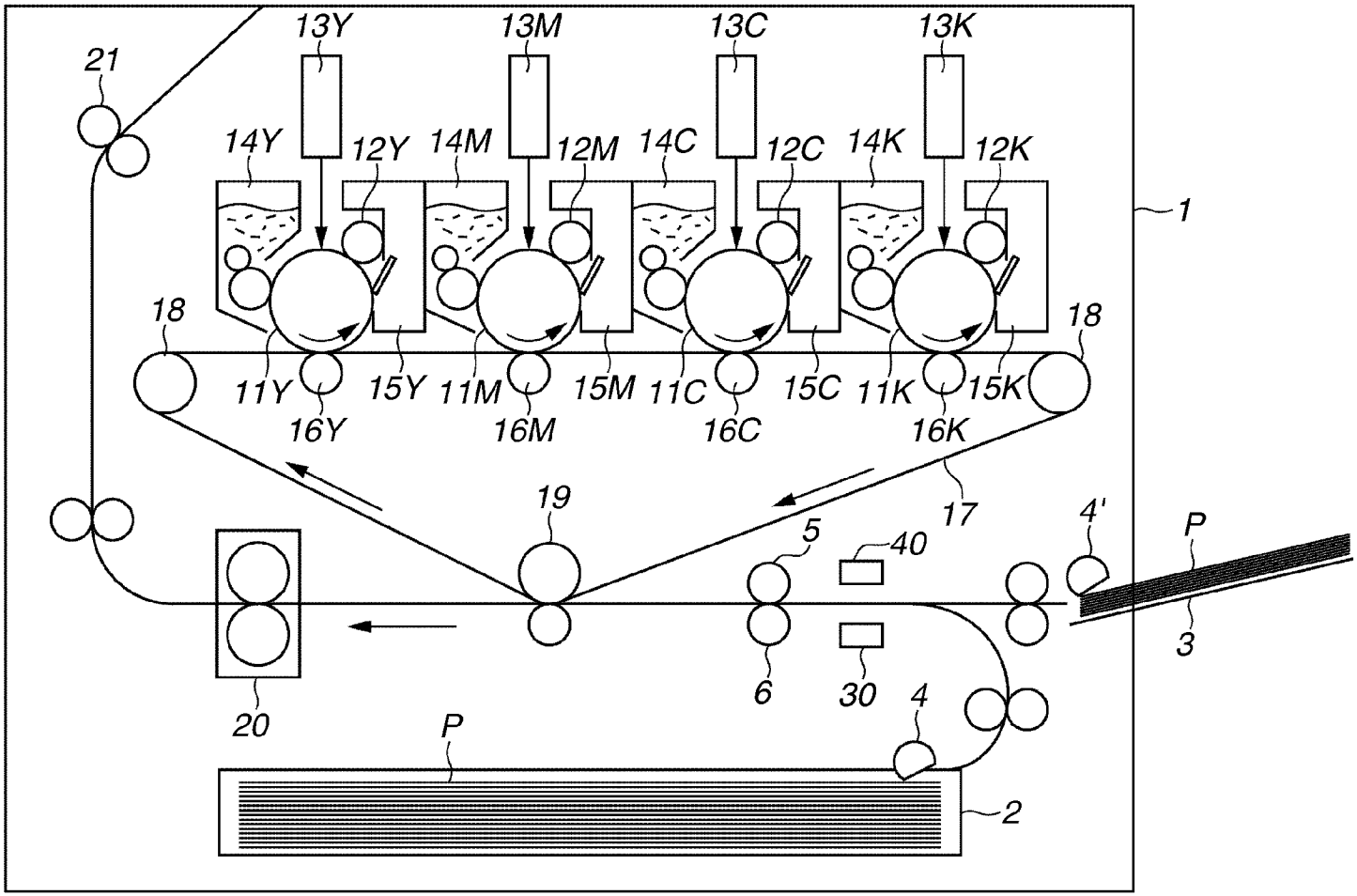
FIG. 11 is a schematic diagram illustrating a configuration of a color image forming apparatus according to a fourth exemplary embodiment.

The recording medium determination apparatus using the grammage detection sensor as described in the first to third exemplary embodiments can be applied, for example, to a copy machine and an image forming apparatus. In the present exemplary embodiment, an example when the recording medium determination apparatus is applied to the image forming apparatus will be described. As illustrated in FIG. 11, the present invention is applied to a color image forming apparatus including an intermediate transfer member and a plurality of image forming units aligned in tandem with each other (also referred to as a "tandem method"). Each configuration of the color image forming apparatus 1 as illustrated in FIG. 11 will be described below.

A paper-feed mechanism for feeding the recording medium includes a paper-feed cassette 2 for storing the recording medium P, a paper-feed tray 3, a paper-feed rollers 4 and 4' for picking up and feeding the recording medium. P from the paper-feed cassette 2 or the paper-feed tray 3 to a conveyance path.

The image forming unit includes each of photosensitive drums 11Y, 11M, 11C, and 11K that support developer for each color of yellow, magenta, cyan, and black. Further, the image forming unit includes charging rollers 12Y, 12M, 12C, and 12K as a primary charging unit for each color for uniformly charging 11Y, 11M, 11C, and 11K to a predetermined electric potential.

The image forming unit includes optical units 13Y, 13M, 13C, and 13K for each color for irradiating a laser beam corresponding to each color image data on to the photosensitive drums 11Y, 11M, 11C, and 11K, which are charged by the primary charging unit, to form an electrostatic latent image.

The image forming unit includes development units 14Y, 14M, 14C, and 14K for visualizing the electrostatic latent image formed on the photosensitive drums 11Y, 11M, 11C and 11K. The image forming unit includes developer conveyance rollers (also referred to as "sleeve rollers") 15Y, 15M, 15C, and 15K for supplying the developer in the development units 14Y, 14M, 14C and 14K to the photosensitive drums 11Y, 11M, 11C, and 11K.

The image forming unit includes an intermediate transfer belt 17 for primarily transferring the image formed on the photosensitive drums 11Y, 11M, 11C, and 11K and primary transfer rollers 16Y, 16M, 16C, and 16K for each color.

The image forming unit further includes a driving roller 18 for driving the intermediate transfer belt 17, a second transfer roller 19 for transferring the image formed on the intermediate transfer belt 17 onto the recording medium P, and a fixing unit 20 for melt-fixing the developer image having transferred onto the recording medium P while the recording medium is carried.

The photosensitive drums 11Y, 11M, 11C, and 11K, the charging rollers 12Y, 12M, 12C, and 12K, the development units 14Y, 14M, 14C, and 14K, and the developer conveyance rollers 15Y, 15M, 15C, and 15K are integrated formed in a unit for each color. The unit including the photosensitive drum, the charging roller, and the development unit is referred to as a cartridge. Each cartridge is formed to be easily attachable to and detachable from the color image forming apparatus 1.

The color image forming apparatus 1 of the electrophotographic method finally forms the image on the recording medium P by using electrophotographic processing.

Firstly, an operation for conveying paper in the image forming operation by the color image forming apparatus 1 will be described.

When the image signal for printing is input to the color image forming apparatus 1, the recording medium P is picked up from the paper-feed cassette 2 or the paper-feed tray 3 and conveyed to the conveyance path by the paper-feed roller 4 or the paper-feed roller 4'.

The recording medium P stops once and waits at a position between the conveyance roller 5 and the conveyance-opposing roller 6 in order to synchronize with the image formed on the intermediate transfer belt 17. Then, the recording medium P is conveyed in synchronization with an operation for forming the image on the intermediate transfer belt 17, and the image formed on the intermediate transfer belt 17 is transferred to the conveyed recording medium P.

The image transferred onto the recording medium P is heated and fixed by a fixing unit 20 that includes a fixing roller and the like, and the recording medium P is discharged to a paper discharge tray (not illustrated) by a paper-discharge roller 21. Then, the image forming operation is ended.

Next, the image forming method using the electrophotographic method will be described.

When the operation for forming the image on the intermediate transfer belt 17 is started, the photosensitive drums 11Y, 11M, 11C, and 11K are charged to a predetermined electrical potential by the charging rollers 12Y, 12M, 12C, and 12K.

The optical units 13Y, 13M, 13C, and 13K scan to expose the surfaces of the charged photosensitive drums 11Y, 11M, 11C, and 11K by the laser beam to form the latent image according to the received image signal.

The electrostatic latent image formed on the surfaces of the photosensitive drums 11Y, 11M, 11C, and 11K are developed as a monochromatic developer image (visible image) respectively by the development units 14Y, 14M, 14C, and 14K and the developer conveyance rollers 15Y, 15M, 15C, and 15K.

These photosensitive drums 11Y, 11M, 11C, and 11K are in contact with the intermediate transfer belt 17 and rotate in synchronization with a rotation of the intermediate transfer belt 17. Each of the developed monochromatic developer images is transferred sequentially by the primary transfer rollers 16Y, 16M, 16C, and 16K onto the intermediate transfer belt 17 to form a multi-colored developer image. The multi-colored developer image is transferred from the intermediate transfer belt 17 onto the recording medium P.

Next, with reference to FIG. 12, an example operation of the image forming apparatus using the recording medium determination apparatus described in the first to third exemplary embodiments will be described.

Figure 12:
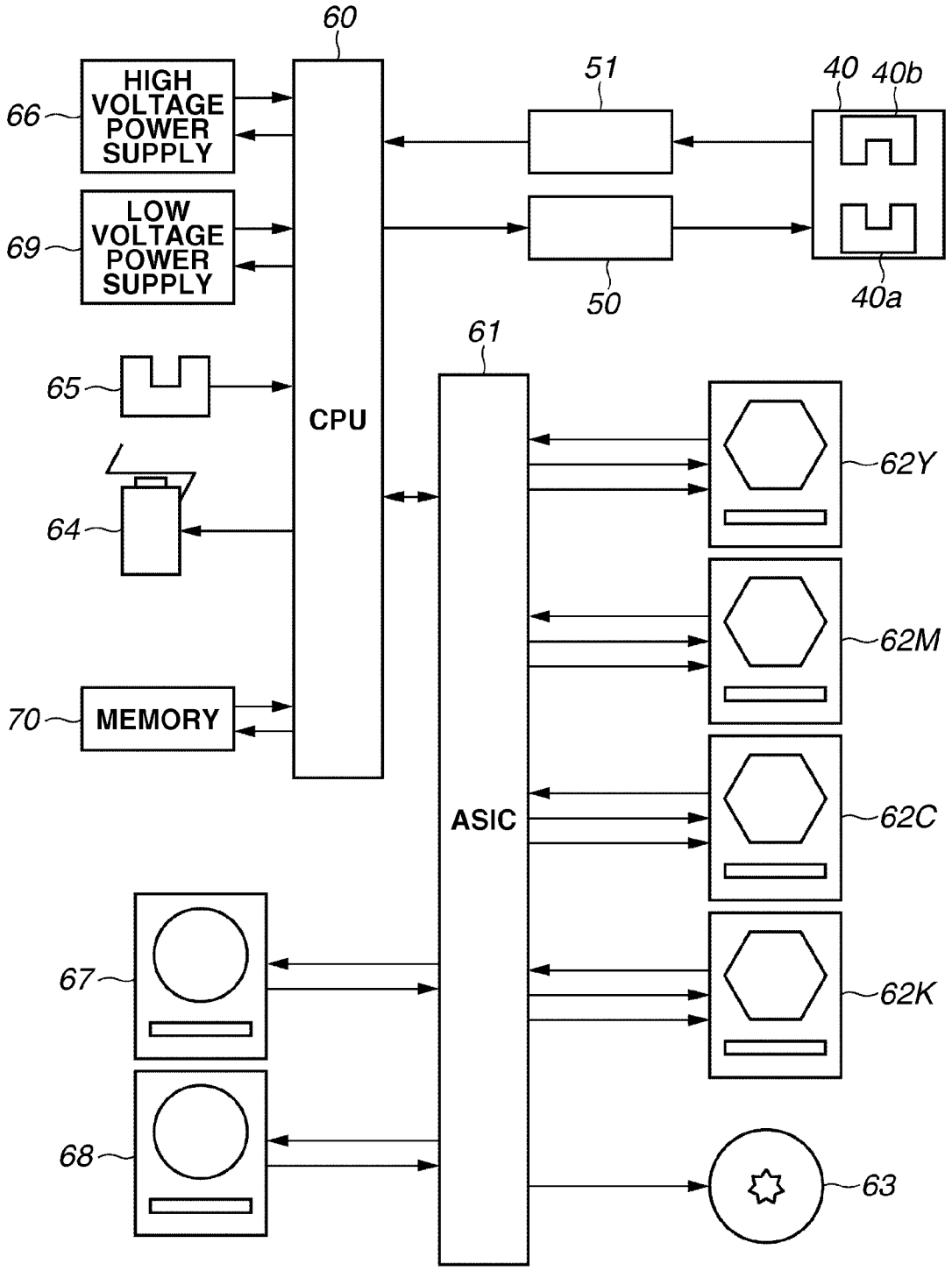
FIG. 12 illustrates a configuration of each unit controlled by a central processing unit (CPU) of the image forming apparatus according to the fourth exemplary embodiment.

FIG. 12 illustrates a configuration of each unit controlled by the CPU 60. In FIG. 12, the CPU 60 controls operations of the transmission unit 30 and the reception unit 40 for respectively transmitting and receiving the ultrasonic wave included in the grammage detection sensor and the transmission control unit 50 and the calculation unit 51, which are the peripheral circuits of the transmission unit 30 and the reception unit 40.

Further, the CPU 60 is connected to units 62Y, 62M, 62C, and 62K each including a polygon mirror (not illustrated), a motor, and a laser device included in each of the optical units 13Y, 13M, 13C, and 13K for each color via an application specific integrated circuit (ASIC) 61. Further, the CPU 60 controls the scanning and exposure of the laser beams in order to form the latent image on the surfaces of the photosensitive drums 11Y, 11M, 11C, and 11K according to the image signal.

Similarly, the CPU 60 controls a paper-feed motor 63 for conveying the recording medium, a paper-feed solenoid 64 used for starting to drive the paper-feed roller for feeding the recording medium, and a paper sensor 65 for detecting whether the recording medium is set at a predetermined position.

Further, the CPU 60 controls high-voltage power supply 66 to supply power for the primary charge, development, and transfer bias necessary for the electrophotographic processing, a drum driving motor 67 for driving the photosensitive drum and the transfer roller, a belt driving motor 68 for driving the intermediate transfer belt 17 and a roller of the fixing unit 20 and a low-voltage power supply unit 69.

Furthermore, the CPU 60 controls a thermistor (not illustrated) in the fixing unit 20 to monitor temperature to maintain fixing temperature constant.

Moreover, the CPU 60 is connected to the memory 70 via a bus (not illustrated), which stores a program and data for executing the controls and the operations described in the first to third exemplary embodiment by the CPU 60. More specifically, the CPU 60 executes the operations of the whole image forming apparatus including the grammage detection sensor by using the program and data stored in the memory 70.

The ASIC 61 performs the speed control of the paper-feed motor 63 and a speed control of the motors in the optical units 13Y, 13M, 13C, and 13K based on an instruction by the CPU 60.

The speed control of the motor (not illustrated) is performed by detecting a tack signal (signals output predetermined numbers per rotation of the motor) and by outputting an acceleration signal or a deceleration signal to the motor so that an interval of the tack signal becomes a predetermined time period. The control circuit including hardware of the ASIC 61 is more advantageous for decreasing a control burden of the CPU 60.

Upon receiving a print command from a computer (not illustrated), the CPU 60 determines whether the recording medium is placed based on the output of the paper sensor 65. As the result of the determination, when the paper is placed, the CPU 60 drives the paper-feed solenoid 64 as well as the paper-feed motor 63, the drum driving motor 67, and the belt driving motor 68 in order to convey the recording medium.

The grammage detection sensor for detecting the recording medium described in the first to third exemplary embodiments is applied to the color image forming apparatus 1 as illustrated in FIG. 11. More specifically, the transmission unit 30 and the reception unit 40 of the grammage detection sensor are disposed in front of the conveyance roller 5 and the conveyance-opposing roller 6 such that the recording medium conveyance path is sandwiched between the transmission unit 30 and the reception unit 40. The grammage detection operation for the recording medium P is performed when the recording medium P stays in front of the conveyance roller 5 and the conveyance-opposing roller 6.

The CPU 60 performs control, for example, such that a condition of the fixing temperature and the conveying speed when the developer image is fixed onto the recording medium are changed according to the determination result (difference of the grammage) of the fed recording medium P.

For example, for the recording medium having a comparatively large grammage, the fixing temperature is set to be higher since the recording medium has a large heat capacity. On the other hand, for the recording medium having a comparatively small grammage, the fixing temperature is set to be lower since the recording medium has a small heat capacity.

Further, regarding the control of the conveying speed, for the recording medium having a large grammage, the conveying speed is set to be slower to increase fixation. On the other hand, for the recording medium having a smaller grammage, the conveying speed is set to be faster than the recording medium having the large grammage.

Setting the conveying speed is realized by resetting a value of a speed control register (not illustrated) in the ASIC 61 by the CPU 60.

It is also possible to change a condition of the fixing temperature and the conveying speed based on the value of the calculated output signal without determining the recording medium P by the CPU 60. In this case, a table in which the value of the calculated output signal, and the fixing temperature condition and the conveying speed corresponding to the calculated output signal value are associated with each other may be stored in the memory 70.

Further, a position where the recording medium is suspended can be variously changed according to the configuration of the apparatus so that the detection can be performed, at least, just before a position where the image is formed (transferred) onto the recording medium P.

As described above, according to the present exemplary embodiment, the grammage detection sensor is applied to the image forming apparatus so that, for example, the fixing temperature condition and the conveying speed of the recording medium as the image forming condition can be optimized for every grammage of the recording medium. Thereby, the high quality image formed on the recording medium can be obtained.

In the present exemplary embodiment, the operation for detecting the grammage by transmitting the ultrasonic wave to the recording medium while the recording medium is stopped is described. However, it is also possible to detect the grammage by transmitting the ultrasonic wave while the recording medium is being conveyed. When detecting the grammage while the recording medium is being conveyed, it is also possible to apply the grammage detection sensor described in the first to third exemplary embodiments.

According to a fifth exemplary embodiment, since a basic configuration except for a method for using the detection result is similar to the first to fourth exemplary embodiments, the description of the detailed basic configuration will be omitted.

Some image forming apparatuses include a temperature sensor therein and performs various controls based on an inside temperature detected by the temperature sensor. Since the detection of the inside temperature is an important function in the apparatus to control the image forming condition, the dedicated temperature sensor is provided in the apparatus.

In the present exemplary embodiment, a method for detecting the temperature in the recording medium determination apparatus by using the ultrasonic wave without providing the temperature sensor in the apparatus will be described.

A method for measuring (estimating) the inside temperature of the image forming apparatus by using the temperature dependency of the transmission speed (v) of the ultrasonic wave signal described in the second exemplary embodiment will be described.

Firstly, when it is previously known that an ambient temperature is a certain temperature (e.g. 25° C.) when shipping, the detection is performed without the recording medium placed between the transmission unit 30 and the reception unit 40 for respectively transmitting and receiving the ultrasonic wave and a time period from the starting time for generating the driving signal to the detecting time of the calculated output signal is measured. Temperature information calculated based on the measurement result is stored in a storage device in the image forming apparatus such as the memory 70.

The timing for detecting the peak (maximum value) of the rising waveform as described in the first exemplary embodiment is defined as, for example, Tp1 in the present exemplary embodiment. The detection timing may also be defined as T0 described in the second exemplary embodiment. A case where the detection timing is defined as Tp1 will be described below.

Next, the detection is performed similarly as described above (detection of the peak of the rising waveform) under an environment with an unknown ambient temperature "k", and a timing Tp2 is measured.

Here, by using an ambient temperature K and a distance D between the transmission unit 30 and reception unit 40, a difference between Tp2 and Tp1 can be expressed as the following formula (7).

$$Tp2-Tp1=D/(331.5+0.607k)-D/(331.5+0.607\times 25) \quad (7)$$

The unknown temperature "k" can be calculated from the formula (7) to acquire the calculated "k"=ambient temperature.

According to the temperature "k" acquired as above, the image forming apparatus can perform various controls. For example, the temperature measurement can be performed for every predetermined period to precisely optimize the change of the image forming condition such as the fixing temperature when the temperature changes more than a predetermined value from the previous measured result. Thus, the image forming apparatus can perform the control so that the optimum, high-quality image can be acquired without being influenced by the temperature change.

Further, according to the present exemplary embodiment, by using the temperature dependency of the transmitting speed (v) of the ultrasonic wave, the ambient temperature of the grammage detection sensor, which is the inside temperature of the image forming apparatus, can be acquired by calculation, thereby realizing a low-cost apparatus without the dedicated temperature sensor therein.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A recording medium determination apparatus that determines a type of a recording medium by using an ultrasonic wave, comprising:

a transmission unit configured to transmit an ultrasonic wave;

a reception unit configured to receive the ultrasonic wave transmitted from the transmission unit and via the recording medium and output a first signal having a peak value at each prescribed period according to the ultrasonic wave being received;

a conversion unit configured to convert the first signal into a second signal by holding a peak value of the first signal and output the second signal; and a determination unit configured to determine the type of the recording medium by using a value of the second signal output by the conversion unit.

2. The recording medium determination apparatus according to claim 1, further comprising a signal output unit configured to output a driving signal for transmitting the ultrasonic wave from the transmission unit, wherein the determination unit determines the type of the recording medium by using a value of the second signal at a time period until a predetermined period elapse from when the signal output unit outputs the driving signal.

3. The recording medium determination apparatus according to claim 2, wherein the predetermined period is a period according to the cycle period of the driving signal output from the signal output unit.

4. The recording medium determination apparatus according to claim 3, wherein the predetermined period is an integer-multiple cycle period of the driving signal.

5. The recording medium determination apparatus according to claim 3, wherein the predetermined period is a time period obtained by adding a half cycle period of the driving signal to an integer multiple of a period of the driving signal.

6. The recording medium determination apparatus according to claim 2, wherein the time period until the predetermined period elapse is a time period until a third or a fourth waveform of the first signal is output after an ultrasonic wave reaches the reception unit.

7. The recording medium determination apparatus according to claim 2, wherein the determination unit determines a grammage of the recording medium by using a maximum value of the second signal at a time period until the predetermined period elapse.

8. The recording medium determination apparatus according to claim 1, wherein the determination unit determines the type of the recording medium by using the second signal when the ultrasonic wave is output with the recording medium being not placed between the transmission unit and the reception unit, and the second signal when the ultrasonic wave is output with the recording medium being placed therebetween.

9. The recording medium determination apparatus according to claim 1, wherein, in a case where a recording medium doesn't exist between the transmission unit and the reception unit, the determination unit determines a time point when a value of the first signal, that is output from the reception unit by receiving an ultrasonic wave transmitted from the transmission unit, exceeds a threshold value, and wherein, in a case where a recording medium exists between the transmission unit and the reception unit, the conversion unit converts the first signal output by the reception unit by receiving an ultrasonic wave transmitted from the transmission unit and being received via the recording medium, into the second signal, and wherein the determination unit determines a type of the recording medium by using a value of the second signal at a time period until a predetermined period elapse from the time point of the determination.

10. The recording medium determination apparatus according to claim 9, wherein the predetermined period is a period according to the cycle period of the driving signal output from the signal output unit.

11. The recording medium determination apparatus according to claim 10, wherein the predetermined period is an integer-multiple cycle period of the driving signal.

12. The recording medium determination apparatus according to claim 10, wherein the predetermined period is a time period obtained by adding a half cycle period of the driving signal to an integer multiple of a period of the driving signal.

13. The recording medium determination apparatus according to claim 9, wherein the time period until the predetermined period elapse is a time period until a third or a fourth waveform of the first signal is output after an ultrasonic wave reaches the reception unit.

14. The recording medium determination apparatus according to claim 9, wherein the determination unit determines a grammage of the recording medium by using a maximum value of the second signal at a time period until the predetermined period elapse.

15. The recording medium determination apparatus according to claim 1, wherein the reception unit receives an ultrasonic wave transmitted from the transmission unit and transmitted through a recording medium and outputs the first signal according to the received ultrasonic wave.

16. The recording medium determination apparatus according to claim 1, wherein the second signal is a signal having the prescribed period.

17. The recording medium determination apparatus according to claim 1, wherein the conversion unit converts the first signal into the second signal by holding a peak value of the first signal after performing a half-wave rectification of the first signal.

18. The recording medium determination apparatus according to claim 1, wherein the determination unit determines a type of the recording medium by using a value of the second signal at a rising portion of a waveform until the first signal is stabilized in a stable status.

19. The recording medium determination apparatus according to claim 18, wherein the stable status is a status that a peak value of the first signal at said each prescribed period doesn't vary.

20. The recording medium determination apparatus according to claim 18, wherein the rising portion is a time period until a third or a fourth waveform of the first signal is output after an ultrasonic wave reaches the reception unit.

21. The recording medium determination apparatus according to claim 18, wherein the determination unit determines a grammage of the recording medium by using a maximum value of the second signal at the rising portion.

22. The recording medium determination apparatus according to claim 1, wherein the determination unit determines a grammage of the recording medium.

23. An image forming apparatus comprising:

an image forming unit configured to form an image on a recording medium;

a transmission unit configured to transmit an ultrasonic wave;

a reception unit configured to receive the ultrasonic wave transmitted from the transmission unit and via the recording medium and output a first signal having a peak value at each prescribed period according to the ultrasonic wave being received;

a conversion unit configured to convert the first signal into a second signal by holding a peak value of the first signal and output the second signal; and a control unit configured to control an image forming condition for the image forming unit by using a value of the second signal output by the conversion unit.

24. The image forming apparatus according to claim 23, wherein the control unit determines a type of the recording medium by using a value of the second signal and sets the image forming condition for the image forming unit according to the type of the recording medium.

25. The image forming apparatus according to claim 23, further comprising a signal output unit configured to output a driving signal for transmitting the ultrasonic wave from the transmission unit, wherein the control unit controls the image forming condition for the image forming unit by using a value of the second signal at a time period until a predetermined period elapse from when the signal output unit outputs the driving signal.

26. The image forming apparatus according to claim 25, wherein the predetermined period is a period according to the cycle period of the driving signal output from the signal output unit.

27. The image forming apparatus according to claim 26, wherein the predetermined period is an integer-multiple cycle period of the driving signal.

28. The image forming apparatus according to claim 26, wherein the predetermined period is a time period obtained by adding a half cycle period of the driving signal to an integer multiple of a period of the driving signal.

29. The image forming apparatus according to claim 25, wherein the time period until the predetermined period elapse is a time period until a third or a fourth waveform of the first signal is output after an ultrasonic wave reaches the reception unit.

30. The image forming apparatus according to claim 25, wherein the control unit controls the image forming condition by using a maximum value of the second signal at a time period until the predetermined period elapse.

31. The image forming apparatus according to claim 23, wherein the control unit sets an image forming condition for the image forming unit by using the second signal when the ultrasonic wave is output with the recording medium being not placed between the transmission unit and the reception unit and the second signal when the ultrasonic wave is output with the recording medium being placed therebetween.

32. The image forming apparatus according to claim 23, wherein, in a case where a recording medium doesn't exist between the transmission unit and the reception unit, the control unit determines a time point when a value of the first signal, that is output from the reception unit by receiving an ultrasonic wave transmitted from the transmission unit, exceeds a threshold value, and wherein, in a case where a recording medium exists between the transmission unit and the reception unit, the conversion unit converts the first signal output by the reception unit by receiving an ultrasonic wave transmitted from the transmission unit and via the recording medium, into the second signal, and wherein the control unit controls the image forming condition by using a value of the second signal at a time period until a predetermined period elapse from the time point of the determination.

33. The image forming apparatus according to claim 32, wherein the predetermined period is a period according to the cycle period of the driving signal output from the signal output unit.

34. The image forming apparatus according to claim 33, wherein the predetermined period is an integer-multiple cycle period of the driving signal.

35. The image forming apparatus according to claim 33, wherein the predetermined period is a time period obtained by adding a half cycle period of the driving signal to an integer multiple of a period of the driving signal.

36. The image forming apparatus according to claim 32, wherein the time period until the predetermined period elapse is a time period until a third or a fourth waveform of the first signal is output after an ultrasonic wave reaches the reception unit.

37. The image forming apparatus according to claim 32, wherein the control unit controls the image forming condition by using a maximum value of the second signal at a time period until the predetermined period elapse.

38. The image forming apparatus according to claim 23, wherein the reception unit receives an ultrasonic wave transmitted from the transmission unit and transmitted through a recording medium and outputs the first signal according to the received ultrasonic wave.

39. The image forming apparatus according to claim 23, wherein the second signal is a signal having the prescribed period.

40. The image forming apparatus according to claim 23, wherein the conversion unit converts the first signal into the second signal by holding a peak value of the first signal after performing a half-wave rectification of the first signal.

41. The image forming apparatus according to claim 23, wherein the control unit controls the image forming condition by using a value of the second signal at a rising portion of a waveform until the first signal is stabilized in a stable status.

42. The image forming apparatus according to claim 41, wherein the stable status is a status that a peak value of the first signal at said each prescribed period doesn't vary.

43. The image forming apparatus according to claim 41, wherein the rising portion is a time period until a third or a fourth waveform of the first signal is output after an ultrasonic wave reaches the reception unit.

44. The image forming apparatus according to claim 41, wherein the control unit controls the image forming condition by using a maximum value of the second signal at a rising portion.

45. The image forming apparatus according to claim 23, wherein the image forming condition is a fixing temperature of fixing an image on a recording medium or a conveyance speed of a recording medium.

* * * * *